US009308981B2

(12) United States Patent
Yasukawa

(10) Patent No.: US 9,308,981 B2
(45) Date of Patent: Apr. 12, 2016

(54) BOAT PROPULSION DEVICE

(71) Applicant: YAMAHA HATSUDOKI KABUSHIKI KAISHA, Iwata-shi, Shizuoka (JP)

(72) Inventor: Hikaru Yasukawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/449,241

(22) Filed: Aug. 1, 2014

(65) Prior Publication Data

US 2015/0151821 A1 Jun. 4, 2015

(30) Foreign Application Priority Data

Nov. 29, 2013 (JP) ..... 2013-248257

(51) Int. Cl.
*B63H 20/24* (2006.01)
*B63H 20/28* (2006.01)
*B63H 20/32* (2006.01)

(52) U.S. Cl.
CPC ..... *B63H 20/245* (2013.01); *B63H 20/28* (2013.01); *B63H 20/32* (2013.01)

(58) Field of Classification Search
CPC ..... B63H 20/00; B63H 21/10; B63H 21/38; F01P 3/202; F01N 3/28
USPC ..... 440/76, 88 J, 88 K, 88 R
See application file for complete search history.

(56) References Cited

U.S. PATENT DOCUMENTS 4,933,809 A * 6/1990 Boede ..... F02B 61/045 440/77
5,556,311 A * 9/1996 Fujimoto ..... 440/89 R
5,595,516 A * 1/1997 Matsumoto et al. ..... 440/89 R
5,813,886 A * 9/1998 Shomura ..... F02B 61/045 440/84
6,250,981 B1 6/2001 Morikami
6,257,940 B1 * 7/2001 Dunham et al. ..... 440/76

FOREIGN PATENT DOCUMENTS

JP 2000-186567 A 7/2000

* cited by examiner

*Primary Examiner* — Lars A Olson
(74) *Attorney, Agent, or Firm* — Keating and Bennett, LLP

(57) ABSTRACT

A boat propulsion device includes an engine unit, an attachment portion, an electrical component, wiring, a holder, and an engine cover. The engine unit includes an engine, an exhaust pipe, and a coolant passage. The engine includes a crankshaft which extends vertically. The exhaust pipe is connected to the engine. The coolant passage is configured to cool the engine or the exhaust pipe. The attachment portion is provided integrally with the engine unit on the outside of the coolant passage. The electrical component is attached to the attachment portion. The wiring is connected to the electrical component. The holder is connected to the engine unit on the outside of the coolant passage and holds the wiring. The engine cover houses the engine unit, the attachment portion, the electrical component, the wiring, and the holder.

10 Claims, 6 Drawing Sheets

BOAT PROPULSION DEVICE

BACKGROUND OF THE INVENTION

1. Field of the Invention

The present invention relates to a boat propulsion device.

2. Description of the Related Art

Boat propulsion devices are provided with an engine and an electrical component arranged on the periphery of the engine. The engine and the electrical component are arranged inside an engine cover. The electrical component needs to be cooled to prevent the electrical component from increasing in temperature due to heat radiated from the electrical component or from the engine. However, space inside the engine cover is limited and thus, in terms of layout, it tends to be difficult to add components to cool the electrical component without increasing the size of the boat propulsion device.

Japan Patent Laid-open Patent Publication JP-A 2000-186567 discloses a boat propulsion device that incorporates the portions for installing the electrical component into an exhaust pipe cover which includes a water jacket. Incorporating the portions for installing the electrical components into the exhaust pipe cover improves the cooling efficiency and reduces the number of parts.

However, if the portions for installing the electrical components are provided in the exhaust pipe cover, the vibration of the engine will be transmitted to the electrical component via the exhaust pipe, causing the electrical component to vibrate. If the electrical component vibrates, the wiring connected to the electrical components will also vibrate and likely interfere with the surrounding components. When the electrical component vibrates and interferes with the surrounding components, the wiring tends to deteriorate due to friction.

SUMMARY OF THE INVENTION

Preferred embodiments of the present invention provide a boat propulsion device that improves the efficiency of cooling the electrical component and prevents the deterioration of the wiring while controlling the size of the boat propulsion device.

A boat propulsion device according to a preferred embodiment of the present invention includes an engine unit, an attachment portion, an electrical component, wiring, a holder, and an engine cover. The engine unit includes an engine, an exhaust pipe, and a coolant passage. The engine includes a crankshaft that extends vertically. The exhaust pipe is connected to the engine. The coolant passage is configured to cool the engine or the exhaust pipe. The attachment portion is provided integrally with the engine unit on the outside of the coolant passage. The electrical component is attached to the attachment portion. The wiring is connected to the electrical component. The holder is connected to the engine unit on the outside of the coolant passage and holds the wiring. The engine cover houses the engine, the exhaust pipe, the electrical component, the wiring, and the holder.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
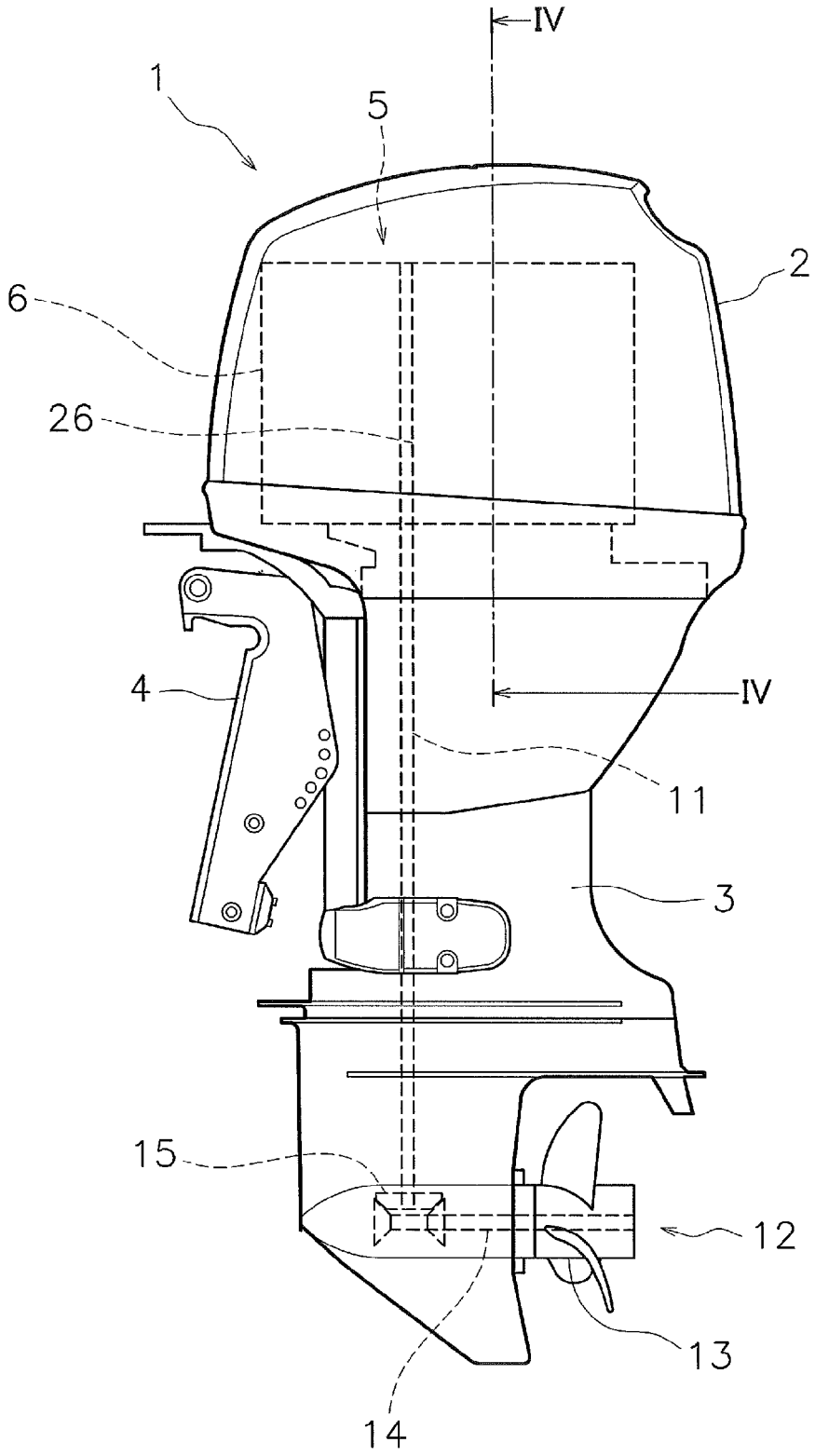
FIG. 1 is a side view of a boat propulsion device according to a preferred embodiment of the present invention.

Preferred embodiments of a boat propulsion device according to the present invention will be described below with reference to the drawings. FIG. 1 is a side view of a boat propulsion device 1 according to a preferred embodiment of the present invention. The boat propulsion device 1 is preferably an outboard motor. The boat propulsion device 1 includes an engine cover 2, a casing 3, a bracket 4, and an engine unit 5. The engine cover 2 houses the engine unit 5. The casing 3 is arranged below the engine cover 2. The boat propulsion device 1 is attached to a hull via the bracket 4.

The engine unit 5 is placed inside the engine cover 2. The engine unit 5 includes an engine 6. A drive shaft 11 is arranged inside the casing 3. The drive shaft 11 is arranged vertically inside the casing 3. The drive shaft 11 is fixed to the crankshaft 26 of the engine 6. A propeller 12 is arranged at the lower portion of the casing 3. The propeller 12 is arranged below the engine 6. The propeller 12 includes a propeller hub 13. The propeller shaft 14 is arranged inside the propeller hub 13. The propeller shaft 14 is arranged longitudinally. The propeller shaft 14 is coupled to the lower portion of the drive shaft 11 via a bevel gear 15.

The drive shaft 11 and the propeller shaft 14 transfer the driving power produced by the engine 6 to the propeller 12 in the boat propulsion device 1. The driving power transferred to the propeller 12 causes the propeller 12 to rotate forwards or backwards. This forward or backward rotation of the propeller 12 produces travel power that allows a boat provided with the boat propulsion device 1 to travel forward or backward.

Figure 2:
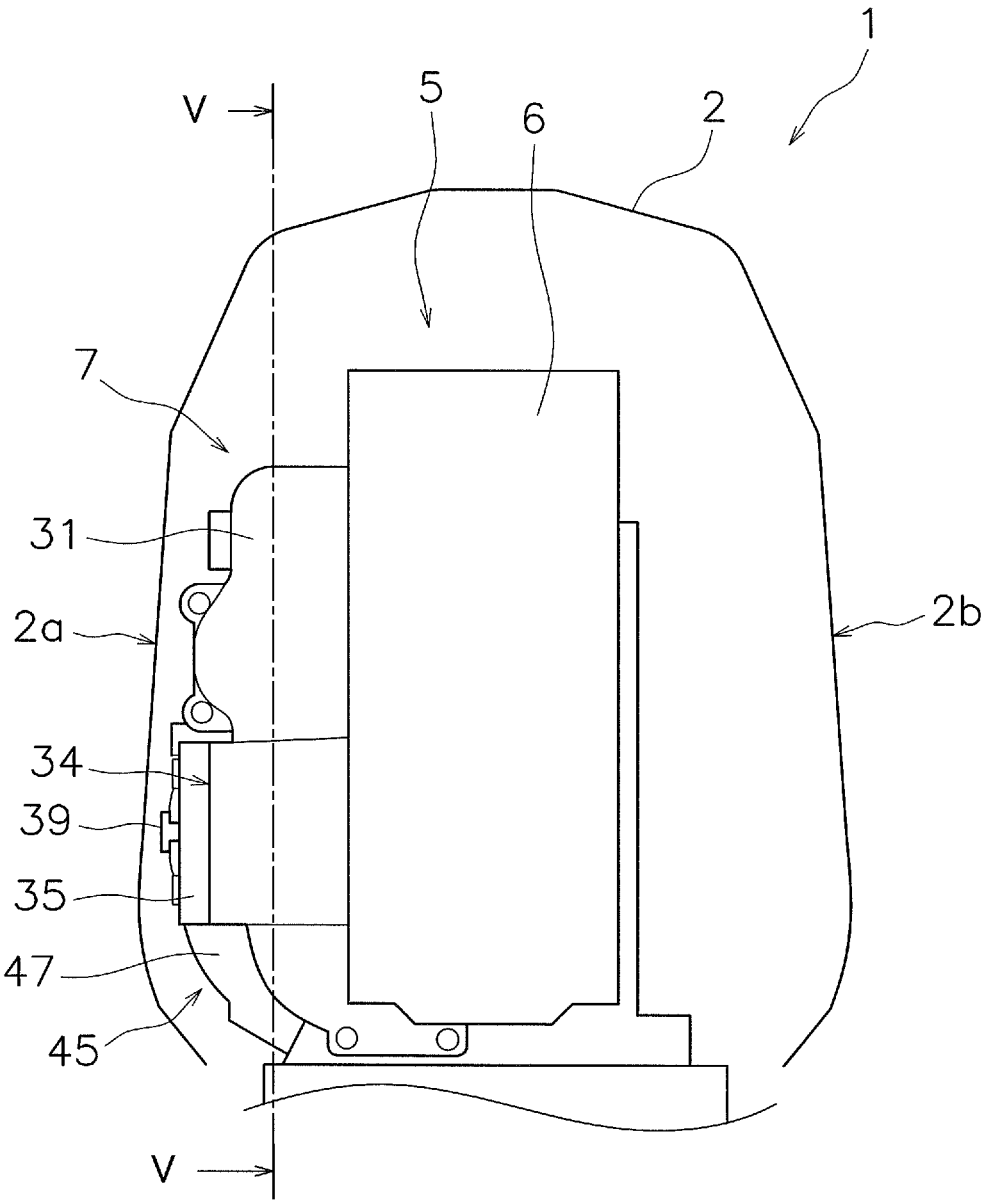
FIG. 2 is a rear view illustrating a portion of the boat propulsion device.

FIG. 2 is a rear view illustrating a portion of the boat propulsion device 1. As illustrated in FIG. 2, the side surfaces 2*a* and 2*b* of the engine cover 2 are sloped so that the width of the engine cover 2 narrows toward the upper portion. That is, the engine cover 2 tapers toward the top. Additionally, for better understanding, the engine cover 2 is illustrated in the cross-sectional view in FIG. 2.

Figure 3:
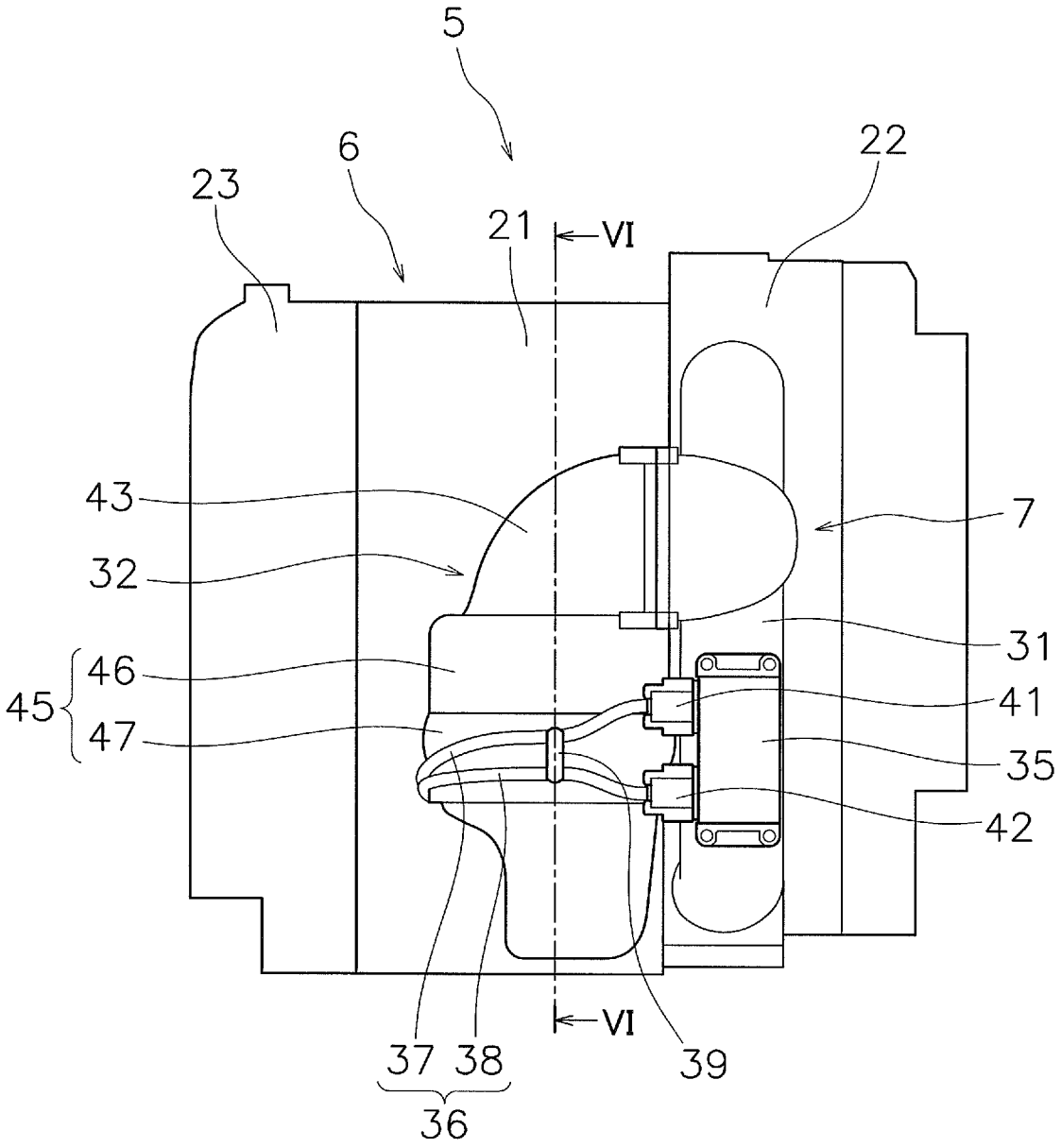
FIG. 3 is a side view of an engine unit.

FIG. 3 is a side view of an engine unit 5. As illustrated in the FIG. 3, the engine 6 includes a cylinder block 21, a cylinder head 22, and a crankcase 23. The cylinder head 22 is arranged behind the cylinder block 21. The crankcase 23 is arranged in front of the cylinder block 21.

The crankshaft 26 (refer to FIG. 1) is arranged inside the crankcase 23. The crankshaft 26 extends vertically. The top end portion of the drive shaft 11 is coupled to the lower end portion of the crankshaft 26. The movement of a plurality of pistons (not shown) arranged inside the cylinder block is transmitted to the drive shaft 11 via the crankshaft 26.

Figure 4:
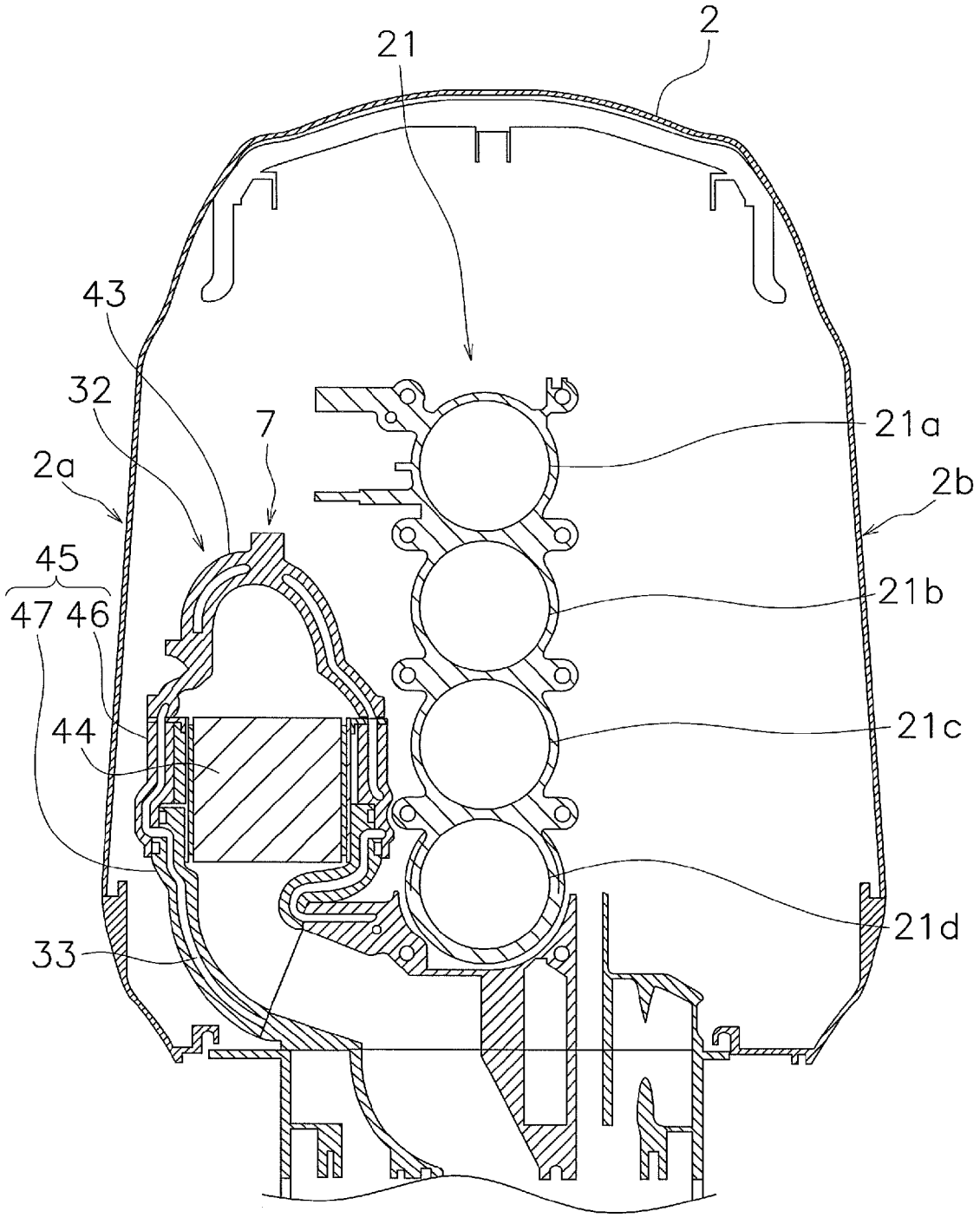
FIG. 4 is a cross-sectional view of the section IV-IV in FIG. 1.

FIG. 4 is a cross-sectional view of section IV-IV of the outboard motor 1 in FIG. 1. As illustrated in FIG. 4, the cylinder block 21 includes a plurality of cylinders 21*a* to 21*d*. The plurality of cylinders 21*a* to 21*d* are arranged vertically.

As illustrated in FIG. 3, the engine unit 5 includes an exhaust pipe 7. The exhaust pipe 7 is arranged beside the engine 6. The exhaust pipe 7 is connected to the engine 6. More specifically, the exhaust pipe 7 includes an exhaust manifold 31 and a catalyst unit 32. The exhaust manifold 31 is connected to the engine 6. The catalyst unit 32 is connected to the exhaust manifold 31. As illustrated in FIG. 4, the exhaust pipe 7 includes a coolant passage 33. The coolant passage 33 allows coolant configured to cool the exhaust pipe 7 to flow therethrough.

Figure 5:
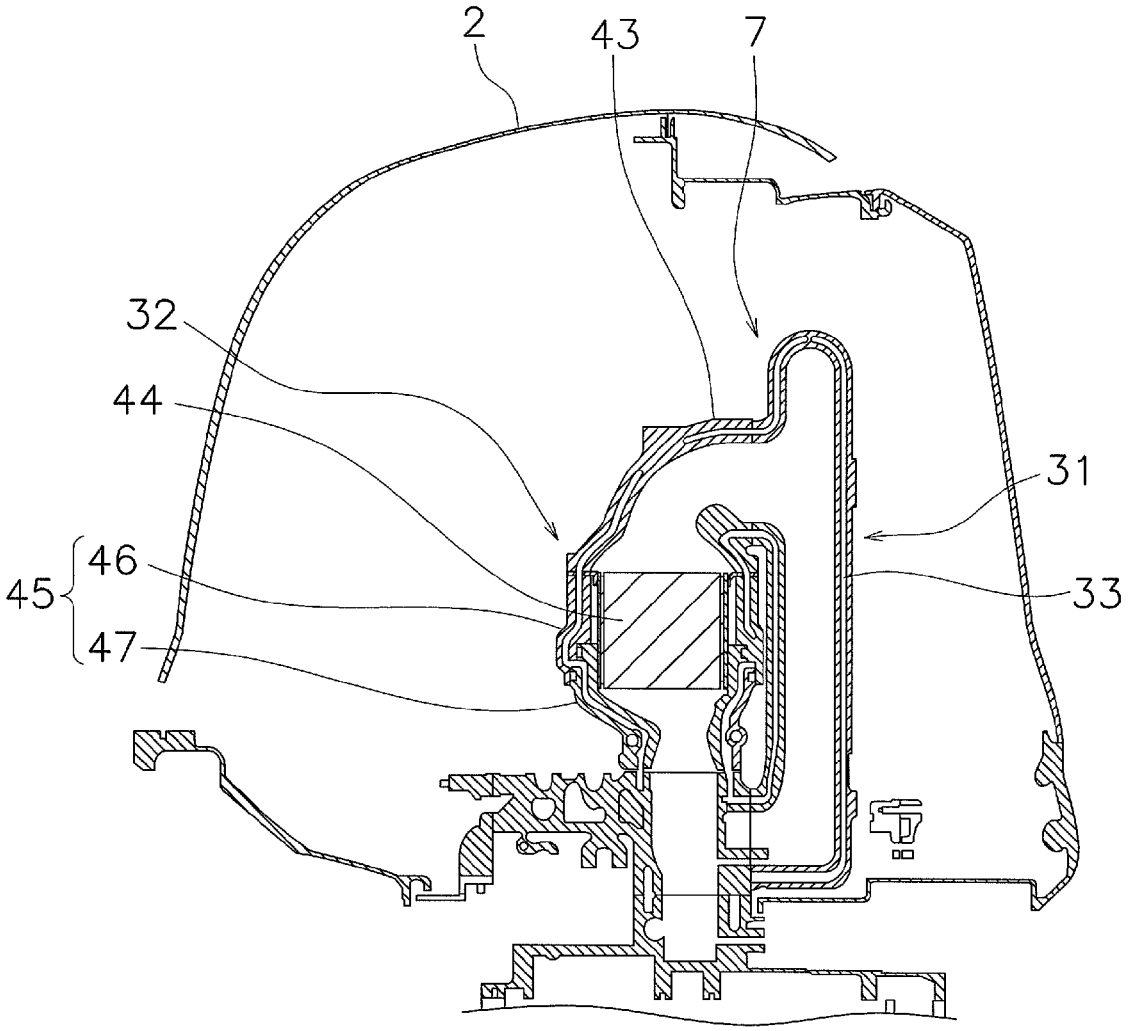
FIG. 5 is a cross-sectional view of the section V-V in FIG. 2.

The exhaust manifold 31 is arranged beside the cylinder head 22. The exhaust manifold 31 is connected to the cylinder head 22. The exhaust manifold 31 is preferably integral with the cylinder head 22. FIG. 5 is a cross-sectional view of the section V-V in FIG. 2. As illustrated in FIG. 5 the exhaust manifold 31 is arranged to extend vertically. The exhaust manifold 31 is connected to a plurality of exhaust ports (not shown) provided in the cylinder head 22. The exhaust manifold 31 collects the exhaust from the plurality of exhaust ports.

As illustrated in FIG. 2, the exhaust manifold 31 is provided with an attachment portion 34. The attachment portion 34 is integrated with the exhaust manifold 31 at the outside of the coolant passage 33 (refer to FIG. 5) inside the exhaust manifold 31. An electrical component 35 is attached to the attachment portion 34. For example, the electrical component 35 is secured to the attachment portion 34 with a bolt. In this preferred embodiment, the electrical component 35 is a rectifier, for example. The electrical component 35 may be another component without being limited to a rectifier. For example, the electrical component 35 may be an ECU or a relay. As illustrated in FIG. 3, the electrical component 35 is substantially square when viewed from the side. The longer side of the electrical component 35 is arranged along the vertical direction. As illustrated in FIG. 2, the electrical component 35 is thin along the lateral direction of the boat propulsion device 1. The electrical component 35 is arranged between the side surface 2*a* of the engine cover 2 and the cylinder head 22.

As illustrated in FIG. 3, a catalyst unit 32 is arranged beside the cylinder block 21. The catalyst unit 32 includes a connecting tube 43, catalyst material 44 (refer to FIG. 4), and a catalyst storage tube 45. The connecting tube 43 is connected to the catalyst storage tube 45. The connecting tube 43 is located above the catalyst storage tube 45. The connecting tube 43 connects the catalyst storage tube 45 and the exhaust manifold 31. The connecting tube 43 curves from the upper end of the catalyst storage tube 45 toward the exhaust manifold 31.

As illustrated in FIG. 4, the catalyst material 44 is located inside the catalyst storage tube 45. The catalyst material 44 supports a catalyst that purifies the exhaust. For example, a three-way catalyst is preferably used. The exhaust traveling through an exhaust passage 16 passes through the catalyst material 44 inside the catalyst storage tube 45 and is purified.

The catalyst storage tube 45 is arranged alongside the exhaust manifold 31 in the longitudinal direction of the boat propulsion device 1. The catalyst storage tube 45 is arranged to extend vertically. The outer diameter of the catalyst storage tube 45 is larger than the outer diameter of the connecting tube 43. The catalyst storage tube 45 includes a first storage tube 46 and a second storage tube 47. The first storage tube 46 and the second storage tube 47 are preferably separate components. The first storage tube 46 and the second storage tube 47 are preferably made from aluminum, for example, but may be made from a different material. The first storage tube 46 and the second storage tube 47 are arranged vertically. The second storage tube 47 is arranged below the first storage tube 46.

The electrical component 35 is arranged alongside the catalyst storage tube 45 in the longitudinal direction of the boat propulsion device 1. As illustrated in FIG. 2, the electrical component 35 overlaps the catalyst storage tube 45 when viewed along the longitudinal direction of the boat propulsion device 1.

As illustrated in FIG. 3, a wiring 36 is connected to the electrical component 35. The wiring 36 is arranged to pass laterally to the catalyst storage tube 45. The wiring 36 is arranged to pass between the side surface 2*a* of the engine cover 2 and the catalyst storage tube 45. More specifically, the wiring 36 includes a first wire 37 and a second wire 38. The first wire 37 is connected to the electrical component 35 via a first connector 41. The second wire 38 is connected to the electrical component 35 via a second connector 42. The second wiring 38 is located below the first wire 37 and lateral to the catalyst storage tube 45.

The exhaust pipe 7 is provided with a holder 39. The holder 39 holds the wiring 36. The electrical component 35 and the holder 39 are arranged on the same side of the engine unit 5. The holder 39 is located between the side surface 2*a* of the engine cover 2 and the wiring 36. As illustrated in FIG. 2, the holder 39 is arranged near the side surface 2*a* of the engine cover 2. The holder 39 is arranged closer to the side surface 2*a* of the engine cover 2 than the electrical component 35. The holder 39 is provided at the position closest to the side surface 2*a* of the engine cover 2 on the exhaust pipe 7.

More specifically, the holder 39 is connected to the catalyst storage tube 45. The holder 39 is located between the inner surface of the engine cover 2 and the catalyst storage tube 45. The holder 39 is connected to the second storage tube 47. The holder 39 is preferably located below the center of the engine 6 in the vertical direction of the engine 6.

Figure 6:
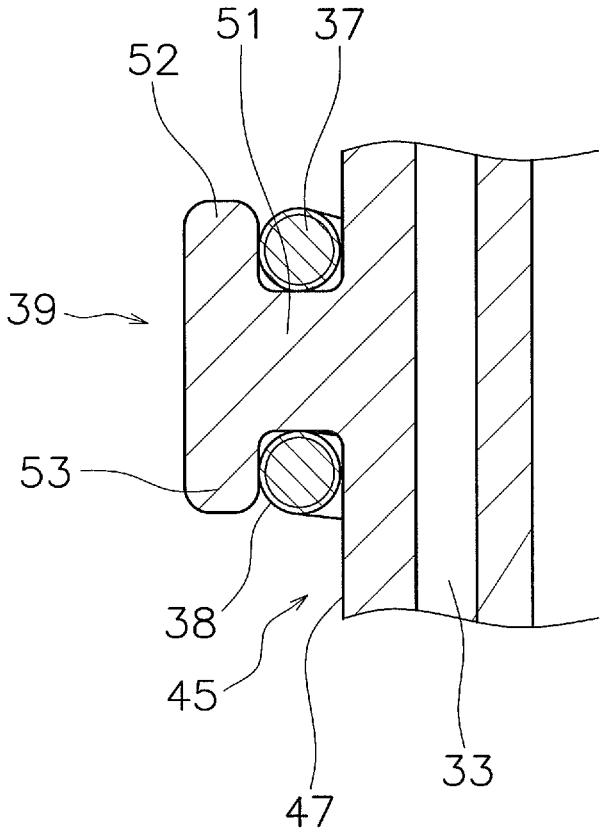
FIG. 6 is a cross-sectional view of the section VI-VI in FIG. 3.

FIG. 6 is a cross-sectional view of the section VI-VI in FIG. 3, illustrating the holder 39 and the surrounding structure. As illustrated in FIG. 6, the holder 39 is connected to the catalyst storage tube 45 outside the coolant passage 33. The holder 39 is preferably T-shaped. That is, the holder 39 includes a connection portion 51, an upper extended portion 52, and a lower extended portion 53. The connection portion 51 connects to the catalyst storage tube 45 and projects horizontally. The upper extended portion 52 extends upward from the connection portion 51. The lower extended portion 53 extends downward from the connection portion 51.

The first wire 37 is held between the upper extended portion 52 and the catalyst storage tube 45. The second wire 38 is held between the lower extended portion 53 and the catalyst storage tube 45. The first wire 37 and the second wire 38 may be bundled together with a cable tie near the holder 39. Thus, when bundled together with a cable tie, the first wire 37 and the second wire 38 are held more securely by the holder 39.

The boat propulsion device 1 according to the present preferred embodiment includes the following features.

The attachment portion 34 configured to attach the electrical component 35 is integrally provided with the engine unit 5 outside the coolant passage 33. Therefore, the cooling efficiency improves and fewer parts are needed. Additionally, the wiring 36 is preferably held by the holder 39. Providing the holder 39 to hold the wiring 36 prevents the wiring 36 from interfering with surrounding components, and prevents deterioration of the wiring 36 due to friction. Moreover, the holder 39 is provided on the engine unit 5 in the same manner as the attachment portion 34, and thus the electrical component 35 and the wiring 36 are subject to the same vibrations. Providing the holder so that the electrical component 35 and the wiring 36 are subject to the same vibrations thus reduces the stress or load on the wiring 36 or the connectors 41 and 42.

The electrical components 35 and the holder 39 are arranged on the same side of the engine unit 5. Arranging the electrical components 35 and the holder 39 on the same side of the engine unit 5 facilitates handling of the wiring 36 compared to when the electrical component 35 is arranged on one side of the engine unit 5, and the holder 39 is arranged on the other side of the engine unit 5.

The holder 39 is located between the inner surface of the engine cover 2 and the wiring 36. Positioning the holder between the inner surface of the engine cover and the wiring allows the holder 39 to prevent the wiring 36 from rubbing on the inner surface of the engine cover 2.

The holder 39 is preferably positioned nearest to the inner surface of the engine cover 2 in the engine unit 5. Positioning the holder 39 nearest to the inner surface of the engine cover provides an efficient arrangement of the wiring 36 while preventing the wiring 36 from rubbing on the inner surface of the engine cover 2.

The holder 39 is preferably T-shaped. The T-shaped holder 39 is configured to hold both the first wire 37 and the second wire 38.

The engine cover 2 tapers towards the upper portion, and therefore the lower the holder 39 in the engine cover 2 the larger the distance that is secured between the engine cover 2 and the holder 39. In this preferred embodiment, the holder 39 is located below the center of the engine 6 in the vertical direction. Therefore, a large distance is secured between the engine cover 2 and the holder 39 compared to when the holder 39 is located further above the center of the engine 6 in the vertical direction.

The electrical component 35 is arranged alongside the catalyst storage tube 45 in the longitudinal direction of the boat propulsion device 1 and overlaps the catalyst storage tube 45 when viewed along the longitudinal direction of the boat propulsion device 1. The outer diameter of the catalyst storage tube 45 is larger than the outer diameter of the connecting tube 43. Thus, a more compact arrangement of the electrical component 35 and the catalyst storage tube 45 is realized.

The holder 39 is located between the inner surface of the engine cover 2 and the catalyst storage tube 45. Accordingly, the thicker the catalyst storage tube 45, the narrower the gap between the inner surface of the engine cover 2 and the catalyst storage tube 45. However, in this preferred embodiment, even if the wiring 36 is arranged within that narrow gap, the holder 39 prevents the wiring 36 from rubbing on the inner surface of the engine cover 2.

The present invention is not limited to the above preferred embodiment, and may be modified in various ways insofar as the modifications do not depart from the spirit and scope of the present invention.

While the above preferred embodiment preferably uses an outboard motor as an example of a boat propulsion device, the invention may be used in other types of boat propulsion devices such as a stern drive.

The attachment portion may be integral with another segment of the engine unit without being limited to the exhaust manifold. For example, the attachment portion may integral with the engine.

The holder may be connected to another segment of the engine unit without being limited to the catalyst storage tube. For example, the holder may be connected to a portion of the exhaust pipe not provided with the catalyst unit. Alternatively, the holder may be connected to the engine. The holder may be another shape such as an L-shape without being limited to a T-shape.

The arrangement of the electrical component, the attachment portion, and the holder is not limited to the arrangement in the above preferred embodiments, and is variable. For example, the electrical component and the attachment portion may be arranged on one side of the engine unit while the holder is arranged on the other side of the engine unit. The entire holder may be located between the inner surface of the engine cover and the wiring. The holder may be arranged at a position other than the position nearest the inner surface of the engine cover in the engine unit. The electrical component need not be limited to a rectifier and may be another device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat propulsion device comprising:
an engine unit including:
an engine including a crankshaft extending vertically;
an exhaust pipe connected to the engine; and
a coolant passage configured to cool the engine or the exhaust pipe;
an attachment portion integral with the engine unit outside the coolant passage;
an electrical component attached to the attachment portion;
a wiring connected to the electrical component;
a holder connected to the engine unit outside the coolant passage, the holder being configured to hold the wiring;
a connector that connects the wiring to the electrical component; and
an engine cover housing the engine unit, the attachment portion, the electrical component, the wiring, and the holder; wherein
the holder is spaced away from the connector.

2. The boat propulsion device according to claim 1, wherein the electrical component and the holder are arranged on a same side of the engine unit.

3. The boat propulsion device according to claim 1, wherein at least a portion of the holder is located between an inner surface of the engine cover and the wiring.

4. The boat propulsion device according to claim 1, wherein the holder is provided at a position nearest to an inner surface of the engine cover in the engine unit.

5. A boat propulsion device comprising:
an engine unit including:
an engine including a crankshaft extending vertically;
an exhaust pipe connected to the engine; and
a coolant passage configured to cool the engine or the exhaust pipe;
an attachment portion integral with the engine unit outside the coolant passage;
an electrical component attached to the attachment portion;
a wiring connected to the electrical component;
a holder connected to the engine unit outside the coolant passage, the holder being configured to hold the wiring; and
an engine cover housing the engine unit, the attachment portion, the electrical component, the wiring, and the holder; wherein
the holder includes:
a connection portion connected to the engine unit, the connection portion projecting horizontally;
an upper extended portion extending upward from the connection portion; and
a lower extended portion extending downward from the connection portion.

6. The boat propulsion device according to claim 1, wherein the engine cover tapers toward an upper portion of the engine cover, and the holder is located below a center of the engine in the vertical direction.

7. A boat propulsion device comprising:

an engine unit including:

an engine including a crankshaft extending vertically;

an exhaust pipe connected to the engine; and a coolant passage configured to cool the engine or the exhaust pipe;

an attachment portion integral with the engine unit outside the coolant passage;

an electrical component attached to the attachment portion;

a wiring connected to the electrical component;

a holder connected to the engine unit outside the coolant passage, the holder being configured to hold the wiring; and an engine cover housing the engine unit, the attachment portion, the electrical component, the wiring, and the holder; wherein the exhaust pipe includes a catalyst and a catalyst storage tube configured to store the catalyst;

the electrical component is arranged alongside the catalyst storage tube in a prescribed direction parallel or substantially parallel to a horizontal direction; and the electrical component overlaps with the catalyst storage tube when viewed from the prescribed direction.

8. The boat propulsion device according to claim 7, wherein the exhaust pipe further includes a connecting tube connected to the catalyst storage tube; and an outer diameter of the catalyst storage tube is larger than an outer diameter of the connecting tube.

9. The boat propulsion device according to claim 8, wherein the holder is connected to the catalyst storage tube, and the holder is located between an inner surface of the engine cover and the catalyst storage tube.

10. A boat propulsion device comprising:

an engine unit including:

an engine including a crankshaft extending vertically;

an exhaust pipe connected to the engine; and a coolant passage configured to cool the engine or the exhaust pipe;

an attachment portion integral with the engine unit outside the coolant passage;

an electrical component attached to the attachment portion;

a wiring connected to the electrical component;

a holder connected to the engine unit outside the coolant passage, the holder being configured to hold the wiring; and an engine cover housing the engine unit, the attachment portion, the electrical component, the wiring, and the holder; wherein the exhaust pipe further includes:

an exhaust manifold connected to the engine;

a catalyst storage tube arranged adjacent to the exhaust manifold in a horizontal direction; and a catalyst stored in the catalyst storage tube; wherein the attachment portion is provided on the exhaust manifold; and the holder is provided on the catalyst storage tube.

* * * * *